United States Patent [19]

Stahlecker

[11] Patent Number: 5,065,571

[45] Date of Patent: Nov. 19, 1991

[54] TANGENTIAL BELT DRIVE FOR A SPINNING OR TWISTING MACHINE

[75] Inventor: Hans Stahlecker, Süssen, Fed. Rep. of Germany

[73] Assignee: Fritz Stahlecker, Fed. Rep. of Germany; a part interest

[21] Appl. No.: 483,713

[22] Filed: Feb. 23, 1990

[30] Foreign Application Priority Data

Feb. 6, 1988 [DE] Fed. Rep. of Germany ..... 3905534

[51] Int. Cl.[5] ..... D01M 13/00

[52] U.S. Cl. ..... 57/105; 57/104

[58] Field of Search ..... 57/104, 105; 474/134, 474/137

[56] References Cited

U.S. PATENT DOCUMENTS

| | | | |
|---|---|---|---|
| 3,974,633 | 8/1976 | Clevenger | 57/105 X |
| 4,730,448 | 3/1988 | Wolf et al. | 57/104 |
| 4,781,015 | 11/1988 | Dinkelmann et al. | 57/104 X |

FOREIGN PATENT DOCUMENTS

| | | | |
|---|---|---|---|
| 3639747 | 5/1988 | Fed. Rep. of Germany . | |
| 237649 | 6/1971 | U.S.S.R. | 57/105 |
| 709261 | 10/1950 | United Kingdom | 57/104 |

*Primary Examiner*—Daniel P. Stodola
*Assistant Examiner*—William Stryjewski
*Attorney, Agent, or Firm*—Evenson, Wands, Edwards, Lenahan & McKeown

[57] ABSTRACT

A tangential belt drive for a spinning or twisting machine is disclosed for a machine having spindles on both sides of the machine. The spindles are combined into several groups in the longitudinal direction of the machine. One tangential belt is assigned to a drive in each case to each group, which belt moves along both sides of the machine. It is provided that the tangential belts of adjacent groups are guided by deflecting guides such that space for the housing of machine frames is left outside the travel paths enclosed by the tangential belts.

11 Claims, 2 Drawing Sheets

TANGENTIAL BELT DRIVE FOR A SPINNING OR TWISTING MACHINE

BACKGROUND AND SUMMARY OF THE INVENTION

The invention relates to a tangential drive for a spinning or twisting machine equipped on both sides of the machine with a plurality of spindles. The spindles are combined into several groups in the longitudinal direction of the machine. One tangential belt respectively is assigned as the drive which moves along both sides of the machine and for which deflecting guides are provided for the deflection from one side of the machine to the other.

In the case of a known construction of the initially mentioned type, disclosed in German Published Examined Application (DE-A) 36 39 747, the tangential belts of the adjacent groups are guided by means of the deflecting guides such that the moving paths of the tangential belts overlap in the longitudinal direction of the machine.

An object of the invention is to improve a tangential belt drive of the initially mentioned type.

This object is achieved in that the tangential belts of adjacent groups are guided by means of deflecting guides in such a manner that, outside the moving paths enclosed by the tangential belts, space is left for the housing of machine frames.

By means of this development, it becomes possible to use endlessly produced tangential belts and to mount them as endless belts since these tangential belts do not move around a machine frame. As a result, gluing processes during the mounting or the replacing of a tangential belt may be avoided. Servicing is therefore significantly simplified. In addition, this type of an endless belt has no joint so that the running behavior is improved.

In a further development of the invention, it is provided that their own separate deflecting guides are assigned to the tangential belts of the individual groups. As a result, the mounting and particularly the replacing of an individual tangential belt can be simplified since, in this case, the tangential belts of the adjacent groups may remain in their position.

In a further development of the invention, a drive shaft is provided which extends through in the longitudinal direction of the machine and carries driving disks of which one respectively is assigned to a tangential belt of a group of spindles in a section extending transversely with respect to the longitudinal direction of the machine. As a result, it is ensured that all groups run synchronously in any operating condition. In an expedient embodiment, it is further provided that the driving disks are each applied directly to the tangential belt and that, in the travel direction of the tangential belt, guide rollers are arranged in front of and behind the driving disks, the shafts of these guide rollers extending in the longitudinal direction of the machine. The tangential belt is therefore rotated and guided around its shaft in the area of the driving disks in such a manner that a sufficient frictional effect is obtained with respect to the driving disk having a horizontal shaft, while all other deflecting guides as well as the spindles are arranged with vertical shafts.

In a further development of the invention, it is provided that a tension roller is assigned to each tangential belt in a section extending transversely to the longitudinal direction of the machine. In this case, it is further provided that the tension roller deflects the tangential belt to the other section extending transversely to the longitudinal direction of the machine, and in that one machine frame is arranged in the area between two opposite deflecting rollers. Thus, in a simple manner, sufficient space is created for being able to house machine frames outside the interior enclosed by the moving paths of the tangential belts.

Other objects, advantages and novel features of the present invention will become apparent from the following detailed description of the invention when considered in conjunction with the accompanying drawings.

DETAILED DESCRIPTION OF THE DRAWINGS

Figure 1:
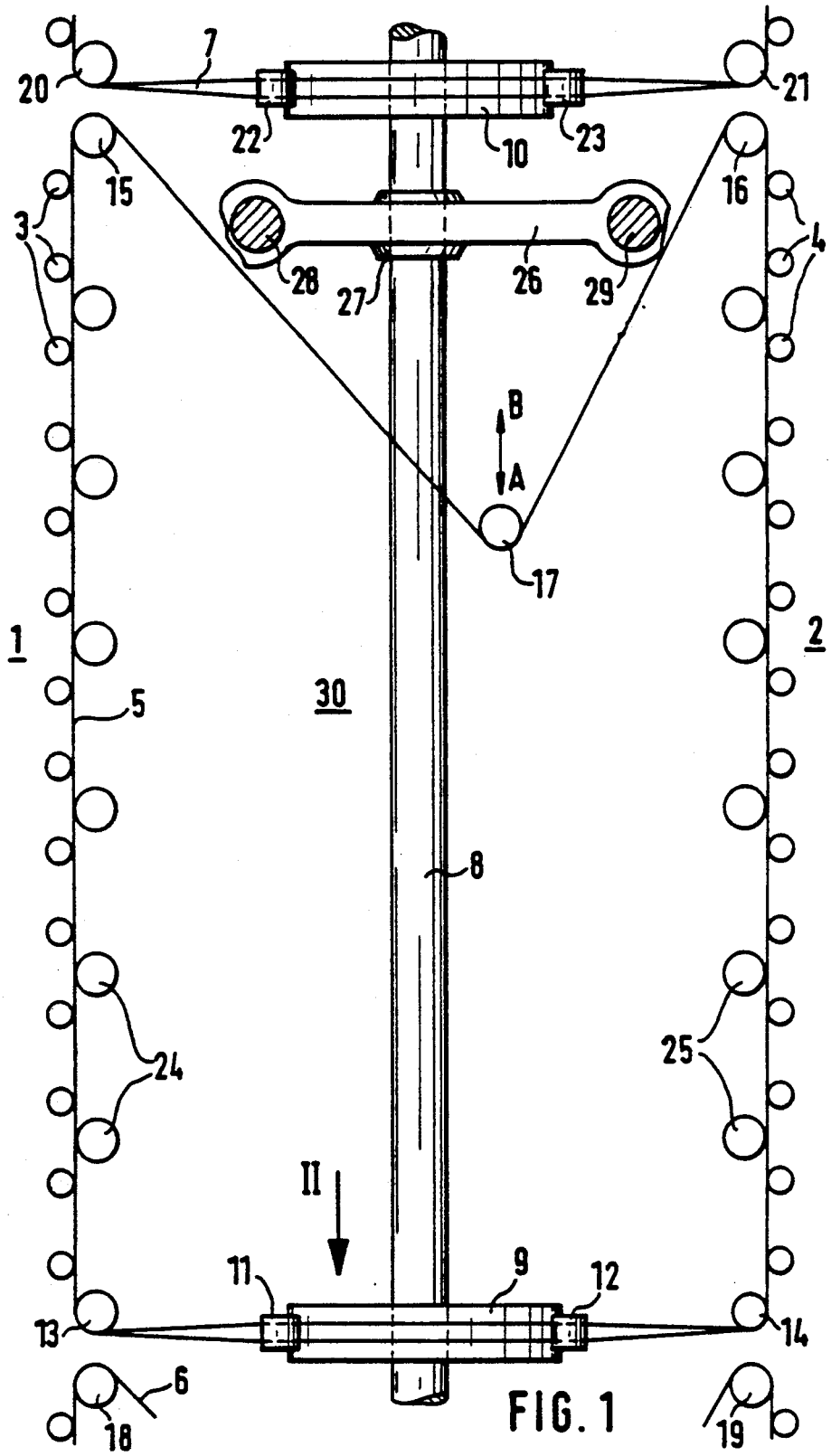
FIG. 1 is a top schematic view of a tangential belt drive for a group of spindles of a two-sided spinning or twisting machine, constructed according to a Preferred embodiment of the invention.
Figure 2:
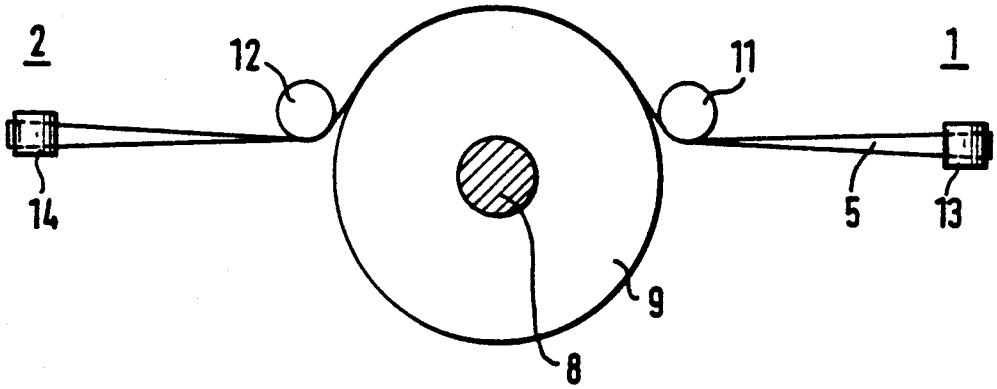
FIG. 2 is a view in the direction of the arrow II of FIG. 1 of the area of a driving disk driving the tangential belt.

In the case of a spinning or twisting machine, a plurality of spinning or twisting spindles 3, 4 is arranged next to one another in one row respectively on both sides 1, 2 of the machine. These spindles 3, 4 are driven by means of a tangential belt drive. In order to be able to use lighter and thinner driving belts, the spindles 3, 4 are subdivided into several groups in the longitudinal direction of the machine, a separate tangential belt 5, 6, 7 being assigned to each of these groups. In the end areas of each group, these tangential belts 5, 6, 7 are guided around deflecting rollers 13, 14, 15, 16 or 18, 19 or 20, 21 in such a manner that, in each case, they move to the opposite machine side.

In one of the sections extending transversely with respect to the longitudinal direction of the machine, the tangential belts 5, 6, 7 are driven by means of a driving disk 9, 10. These driving disks 9, 10 are arranged on a common drive shaft 8 which extends in the longitudinal direction of the machine and preferably in the center of the machine and which, at the end of the machine, is driven by a common driving motor. In the area of the driving disks 9, 10, the tangential belts 5, 6, 7, by means of guide rollers 11, 12; 22, 23 arranged in front and behind the driving disks, are turned such around their longitudinal shaft that they rest against the circumference of the driving disks 9, 10 by means of a flat face. The guide rollers 11, 12; 22, 23, which have rotating shafts that are in parallel to the drive shaft 8, are arranged such that the tangential belt 5, 6, 7 winds around the driving disks 9, 10 at approximately 180 degrees. In the case of the tangential belts 5, 6, 7 used as a result of the subdivision into groups, such a turning is easily possible because of their narrow width and thickness. Behind each spindle 3, 4, on the side which, in each case, is opposite the wharves of the spindles 3, 4, a pressure roller 24, 25 is arranged by means of which sufficient driving pull is provided. These pressure rollers 24, 25 are preferably arranged in a stationary manner. In their construction, these pressure rollers may correspond to the deflecting rollers 13, 14, 15, 16; 18, 19; 20, 21 together with which they are each disposed in a common plane extending in the longitudinal direction of the machine.

As shown for the tangential belt 5, the tangential belts 5, 6, 7, in each case, in the area facing away 9 from the driving disk, in which they move from one side of the machine to the other, are tensioned by means of a tension roller 17 which can be adjusted in the direction of the arrows A and B. By means of this tension roller 17, the travel path of the tangentional belt 5, just like the travel path of the adjacent tangential belts 6, 7 is deflected such that an approximately triangular area is obtained which is located outside the travel path enclosed by the tangential belts 5, 6, 7 and in which a machine frame 26 is arranged. In these machine frames 26, the drive shaft 8 is disposed by means of bearings 27. These machine frames 26 also contain columns 28 projecting farther upward which carry drafting units and sliver spool creels which are not shown.

Since the machine frames 26 are not arranged within the area 30 which is enclosed by the travel path of the tangential belts 5, 6, 7, it is possible to use endless tangential belts 5, 6, 7 which were previously manufactured as endless belts and can be mounted in the endless form.

Since separate deflecting guides in the form of deflecting rollers 13, 14, 15, 16; 18, 19; 20, 21 are in each case provided for the tangential belts 5, 6, 7, it is possible to arrange all the tangential belts 5, 6, 7 at the same height. In addition, it is possible to mount or demount one of the tangential belts 5, 6, 7 without interfering with the tangential belts 5, 6, 7 adjacent to it.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A tangential belt drive for a spinning or twisting machine equipped on each of two lateral sides with a row of a plurality of spindles, comprising;

an endless tangential drive belt, belt guides for guiding movement of the drive belt along the two lateral sides of the machine to drive the spindles, a drive shaft extending through in the longitudinal direction of the machine in between said two lateral sides, a belt drive disk carried by the drive shaft and drivingly engaged with the drive belt along the circumference of the drive disk above the drive shaft, said drive disk being disposed at a first longitudinal end of the two rows of spindles, and deflecting guide means disposed at a second opposite longitudinal end of the two rows of spindles for deflecting the travel path of the drive belt from one of said rows to the other of said rows, wherein said deflecting guide means includes a tension roller disposed vertically above the drive shaft and rotatable about a vertical axis extending perpendicular to the plane of the drive shaft axis and located closer to the drive disk than are end most belt guides at the second end of the rows of spindles to thereby form a belt travel path with a triangular opening on the outside which faces away from the belt drive disk and serves as a mounting space for machine frame elements.

2. A tangential belt drive according to claim 1, wherein the end most belt guides at the second end of the rows of spindles and corresponding end most belt guides at the first end of the rows of spindles are disposed at respective four corners of a rectangular configuration.

3. A tangential belt drive according to claim 2, wherein a plurality of similar endless tangential drive belts and associated rows of spindles are arranged along the length of the drive shaft, and wherein respective belt drive disks are provided on said drive shaft for each said endless tangential belts.

4. A tangential belt drive according to claim 2, wherein, intermediate the endmost belt guides, respective pressure rollers are disposed for pressing the drive belt against the spindles to drive the spindles.

5. A tangential belt drive according to claim 4, wherein a plurality of similar endless tangential drive belts and associated rows of spindles are arranged along the length of the drive shaft, and wherein respective belt drive disk are provided on said drive shaft for each said endless tangential belts.

6. A tangential belt drive according to claim 4, wherein each of the pressure rollers are spaced longitudinally from one another by two of said spindles.

7. A tangential belt drive according to claim 1, wherein guide rollers are disposed at the first longitudinal end of the two rows of spindles for guiding the drive belt in driving engagement with said drive disk and guiding the drive belt path between the rows of spindles.

8. A tangential belt drive according to claim 7, wherein said guide rollers are disposed respectively upstream and downstream of the guide disk to guide the drive belt against a top portion of the circumference of the drive disk.

9. A tangential belt drive according to claim 8, wherein a plurality of similar endless tangential drive belts and associated rows of spindles are arranged along the length of the drive shaft, and wherein respective belt drive disks are provided on said drive shaft for each said endless tangential belts.

10. A tangential belt drive according to claim 1, wherein said tension roller is disposed laterally of the drive shaft.

11. A tangential belt drive according to claim 1, wherein a plurality of similar endless tangential drive belts and associated rows of spindles are arranged along the length of the drive shaft, and wherein respective belt drive disks are provided on said drive shaft for each said endless tangential belts.

* * * * *

UNITED STATES PATENT AND TRADEMARK OFFICE

CERTIFICATE OF CORRECTION

PATENT NO. : 5,065,571

DATED : November 19, 1991

INVENTOR(S) : Hans Stahlecker

It is certified that error appears in the above-identified patent and that said Letters Patent is hereby corrected as shown below:

On the title page, item [30], should be corrected to read

--[30] Foreign Application Priority Data

February 23, 1989 [DE] Federal Republic of Germany... 3905534--

Signed and Sealed this

Twenty-fifth Day of October, 1994

*Attest:*

*Attesting Officer*

Bruce Lehman

BRUCE LEHMAN

*Commissioner of Patents and Trademarks*